US005906318A

United States Patent [19]

Gurko, III et al.

[11] Patent Number: 5,906,318

[45] Date of Patent: May 25, 1999

[54] SPRAY PAINT SYSTEM WITH MULTI-CHAMBERED, MIXING RESERVOIR

[76] Inventors: Thomas Gurko, III, 1872 Seattle St., Cuyahoga Falls, Ohio 44221; Harold Wiegand, 9218 Caanbrook Dr., Northfield Village, Ohio 44067

[21] Appl. No.: 08/963,594

[22] Filed: Oct. 31, 1997

[51] Int. Cl.[6] ..... B67D 5/02

[52] U.S. Cl. ..... 239/304; 239/305; 222/136

[58] Field of Search ..... 239/304, 305; 222/136, 129, 325

[56] References Cited

U.S. PATENT DOCUMENTS

| | | | |
|---|---|---|---|
| 2,850,421 | 9/1958 | Thompson | 154/101 |
| 3,485,453 | 12/1969 | McGinnis et al. | 239/77 |
| 3,507,451 | 4/1970 | Johnson | 239/305 |
| 3,598,322 | 8/1971 | Rupert et al. | 239/410 |
| 4,193,546 | 3/1980 | Hetherington et al. | 239/112 |
| 5,052,623 | 10/1991 | Nordeen | 239/305 |
| 5,279,329 | 1/1994 | Pippel | 137/625.29 |
| 5,299,737 | 4/1994 | McGinnis et al. | 239/77 |
| 5,332,157 | 7/1994 | Proctor | 239/304 |
| 5,398,846 | 3/1995 | Corba et al. | 222/1 |
| 5,402,916 | 4/1995 | Nottingham et al. | 222/134 |
| 5,417,372 | 5/1995 | Portugal | 239/428 |
| 5,419,491 | 5/1995 | Breitsprecher | 239/9 |
| 5,421,900 | 6/1995 | Clontz | 134/14 |
| 5,474,609 | 12/1995 | Mulder et al. | 118/308 |

*Primary Examiner*—Andres Kashnikow
*Assistant Examiner*—David Deal

[57] ABSTRACT

An apparatus with two identical fluid reservoirs for the containment of paint or other finishes to be applied by spraying using compressed air is disclosed. Each of the two reservoirs is connected via metallic tubing to a spray mechanism of conventional design. Each tubing line is equipped with an integral shutoff valve to allow the user to select which paint or finish is applied. When the user wishes to change to the opposing reservoir, both shutoff valves are closed and the remaining paint in the tubing and spray mechanism is blown through. Then the shutoff valve on the desired reservoir is opened allowing the desired paint or finish to be applied. The operating controls as well as the physical weight, center of gravity and balance are similar to that experienced with a conventional single reservoir, air powered, paint gun, allowing the user to quickly become accustomed to the present invention. Preparation, use and post-use clean up are accomplished using readily known procedures and common practices.

6 Claims, 4 Drawing Sheets

SPRAY PAINT SYSTEM WITH MULTI-CHAMBERED, MIXING RESERVOIR

BACKGROUND OF THE INVENTION

1. Field of the Invention

The present invention relates generally to spray guns used for painting and, more particularly, to spray paint system having dual paint storage reservoirs.

2. Description of the Related Art

As is well-known in the art, delivery and application of paints and coatings by spray atomization is widely used. Many devices common known as "spray guns" have been developed, and have become widely standardized for various specific applications. Although differing applications can result in different standards, in general the standard spray gun features only a only a one-reservoir liquid storage and delivery system, and therefore can handle only one type of paint or liquid coating at any given moment.

A search of the prior art did not disclose any patents that read directly on the claims of the instant invention; however, the following references were considered related:

| U.S. Pat. No. | Inventor | Issue Date |
|---|---|---|
| 5,474,609 | Mulder et al. | Dec. 12, 1995 |
| 5,421,900 | Clontz | Jun. 6, 1995 |
| 5,419,491 | Breitsprecher | May 30, 1995 |
| 5,417,372 | Portugal | May 23, 1995 |
| 5,299,737 | McGinnis et al | Apr. 5, 1994 |
| 5,279,329 | Pippel | Jan. 18, 1994 |
| 4,193,546 | Hetherington | Mar. 18, 1980 |
| 3,598,322 | Rupert et al. | Aug. 10, 1971 |
| 3,485,453 | McGinnis | |
| 2,850,421 | Thompson | Sept. 2, 1968 |

Although many of these references incorporate features that may be present in the current invention, none address the present problems directly, nor incorporate the features of the present invention in combination. By way of example and not definitive clarification, the '609 reference addresses a powder delivery system for non-solvent based coating, and addresses some unique problems associated with the fluidizing and delivery of such coatings. The '900 reference discloses a cleaning method incorporating a step sequence of multiple fluid delivery. In the '737 reference discloses an intermittent flushing system, as the –453 reference discloses an automatic flushing system.

Closely related in the '419 reference, in which mixing of dual atomized streams is disclosed at a spray head, and the '322 reference, in which 2 liquids pass through a common exit at separate times. A need has therefore been felt for an improved but less complex mechanism that can reservoir and deliver multiple fluid coatings to a conventional spray head in a separate or combined manner.

SUMMARY OF THE INVENTION

Therefore, it is an object of the invention to indicate a device of the type disclosed above which avoids the disadvantages inherent in the state of the art. In particular, the device is to be capable of reservoiring multiple fluid coatings for deliver to an otherwise conventional spray gun head.

It is therefore an object of the present invention to provide an improved spray paint system with multi chambered, mixing reservoir.

It is a feature of the present invention to provide an improved liquid coating delivery system that is capable of being utilized with multiple coatings in sequence, or in combination.

Briefly described according to the preferred embodiment of the present invention, a twin chamber spray system is disclosed in which dual liquid reservoirs are in fluid communication with a spray gun. Presently, conventional spray guns feature only one reservoir, and therefore can handle only one type of paint at any given moment. Each reservoir may be filled with paint, sealant, base coat or any other substance needed. A plastic strip surrounds the reservoir canisters, and locks them into play. This prevents any slipping or the possibility that a canister may become dislodged. It is envisioned that each reservoir will hold up to one pint of paint. Independent shut off valves control from which reservoir the fluid is delivered.

An advantage of the present invention is that multiple reservoir containers are provided that attached easily and independently to a spray gun utilizing existing, standard connections, allowing multiple applications to occur in a quick, easy manner.

Another advantage of the present invention is that is can be utilized with existing product lines in conjunction with existing tools and hardware product.

Further, a preferred embodiment of the present invention can allow the user to select which reservoir is delivering coating, thereby allowing greater control of the spray process.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures.

Figure 1:
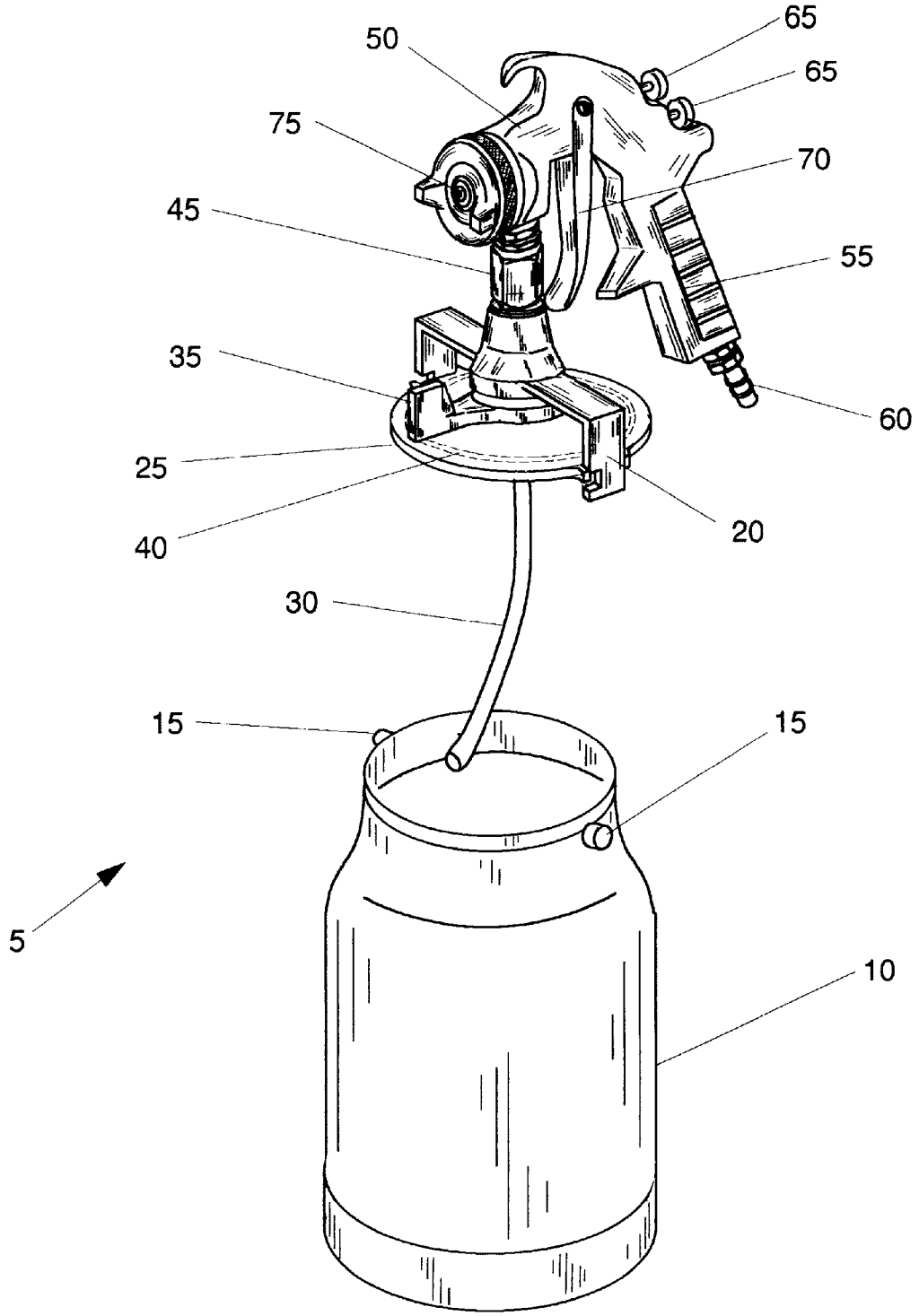
FIG. 1 is an exploded perspective view of the prior art as it relates to a conventional single reservoir, air powered, paint gun.

Referring now to FIG. 1, an exploded perspective view of the prior art as it relates to a conventional single reservoir, air powered, paint gun 5 is shown. A single reservoir 10 is provided which holds an approximate quantity of one quart liquid. The single reservoir 10 is provided with two connecting studs 15 to provided firm mechanical attachment to an attachment clamp bar 20. When a single reservoir cap 25 is placed over the opening of the single reservoir 10, a single dip tube 30 is inserted into the pain or finish contained within the single reservoir 10. The attachment clamp bar 20 then attaches to the connecting studs 15 and with the aid of a rotating clamp lock 35 and a single reservoir cap sealing gasket 40 (located on the underside of the single reservoir cap 25 shown in phantom), an airtight seal between the single reservoir cap 25 and the single reservoir 10 is established. The paint or finish is then drawn up through a connection collar 45 to be mixed with air in a paint mixing body 50. Located at the bottom of a handle 55 is an air connection inlet 60. The air connection inlet 60 is used to connect the conventional single reservoir, air powered, paint gun 5 to a source of pressurized air, such as would be furnished by an air compressor (not shown). Located at the top of the handle 55, at the rear of the paint mixing body 50 are a pair of mixture adjustment controls 65. A trigger 70 is then provided to allow the adjusted air pressure to be mixed with the paint in the paint mixing body 50 and expelled through a paint orifice 75. The above description associated with FIG. 1 is to establish a base of current, conventional single reservoir, air powered paint guns and how this technology relates to the present invention, which be described hereinbelow.

Figure 2:
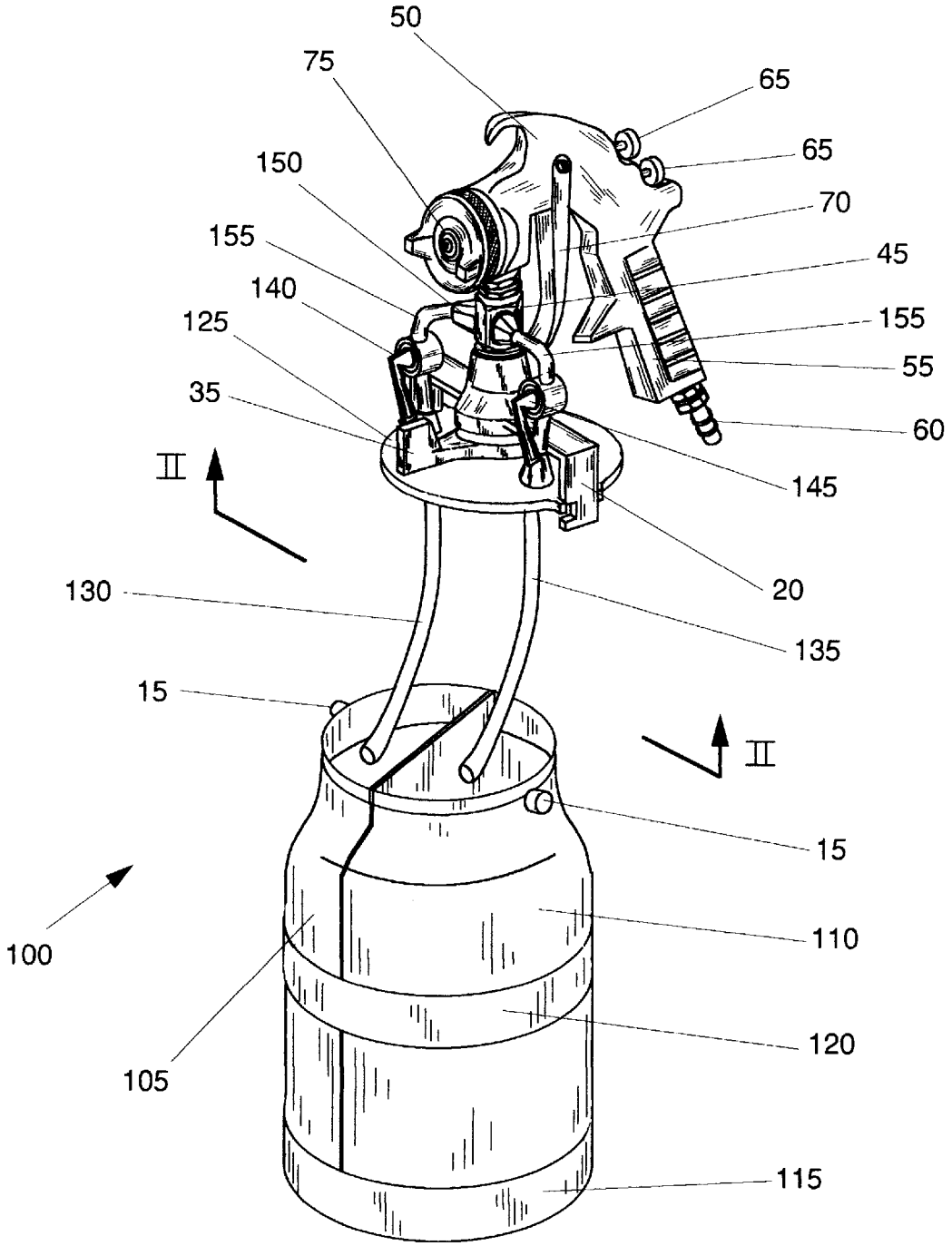
FIG. 2 is an exploded perspective view of the dual reservoir, air powered, paint gun according to the preferred embodiment of the present invention.

Referring next to FIG. 2, an exploded perspective view of a dual reservoir, air powered, paint gun 100 is shown according to the preferred embodiment of the present invention. A first paint reservoir 105 is provided in conjunction with a second paint reservoir 110. The capacity of each first paint reservoir 105 and second paint reservoir 110 is one pint liquid. The first paint reservoir 105 and the second paint reservoir 110 are held in physical contact with one another by a retaining base ring 115 and a retaining clamp 120. The functional relationship of the first paint reservoir 105 and the second paint reservoir 110 and how they operation in conjunction with the retaining base ring 115 and the retaining clamp 120 will be described in greater detail hereinbelow. Both the first paint reservoir 105 and the second paint reservoir 110 are each equipped with a single connecting studs 15, so that the attachment clamp bar 20 may mate with them in a manner similar to that described for the conventional single reservoir, air powered, paint gun 5 as described in FIG. 1. A dual reservoir cap 125 is provided with a first dip tube 130 and a second dip tube 135 for insertion into the first paint reservoir 105 and the second paint reservoir 110 respectively. Located atop each of the first dip tube 130 and the second dip tube 135 is a first shutoff valve 140 and a second shutoff valve 145 respectively. A tee section 150 with two sections of tubing elbows 155 provides a common junction from the output of both the first shutoff valve 140 and the second shutoff valve 145. The common output of the tee section 150 joins to the connection collar 45 by a threaded connection identical in appearance and function to the connection collar 45 shown in FIG. 1. A rotating clamp lock 35, also identical in appearance and function to the rotating clamp lock 35 shown in FIG. 1, provides a secure locking means between the first paint reservoir 105/second paint reservoir 110 combination and the dual reservoir cap 125. The section of the dual reservoir, air powered, paint gun 100 comprising the paint mixing body 50, the handle 55, the air connection inlet 60, the mixture adjustment controls 65, the trigger 70, and the paint orifice 75 are all identical in appearance and function to the same said components as aforementioned discussed in FIG. 1.

Figure 3:
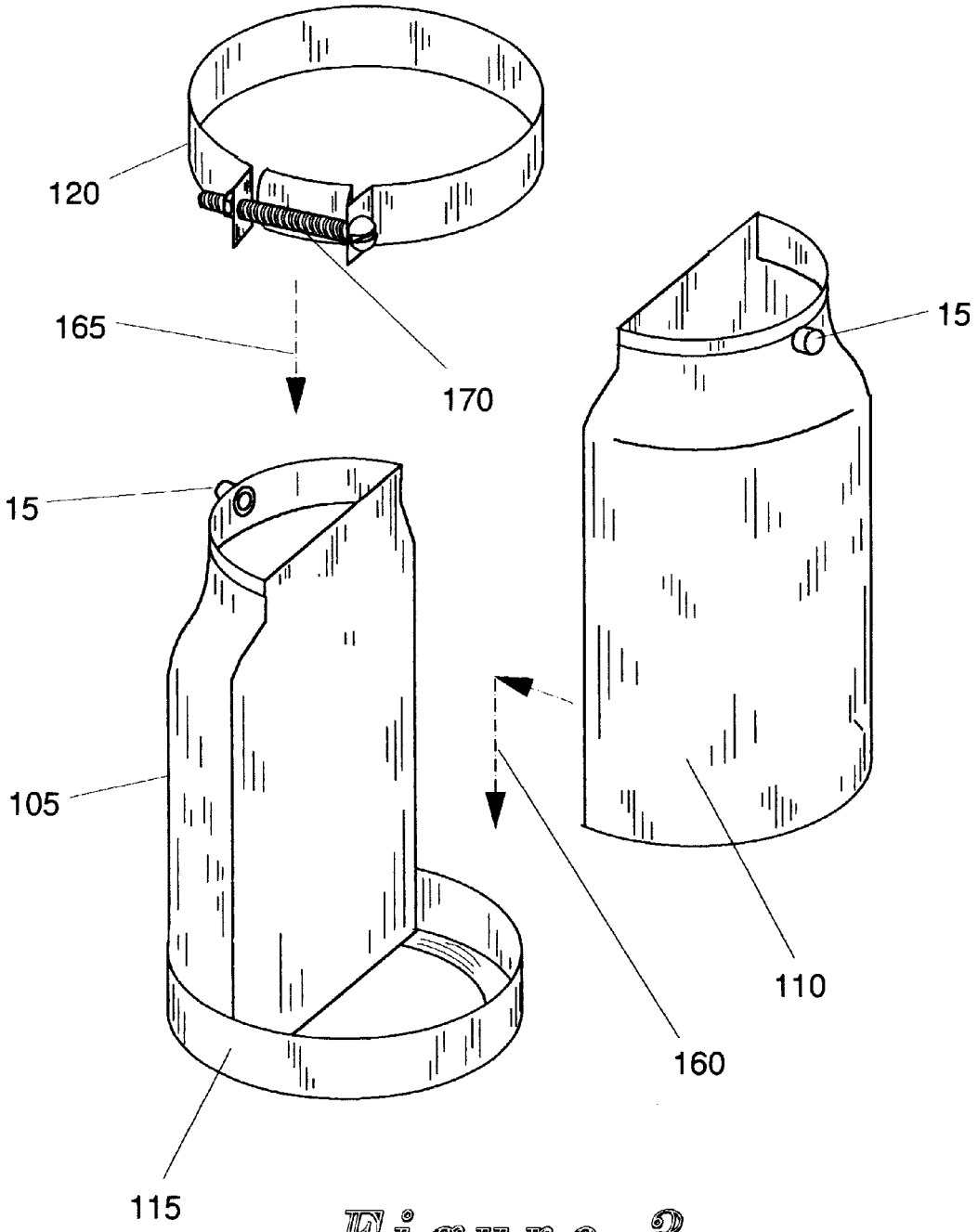
FIG. 3 is an exploded perspective view of the dual paint reservoirs as used with the present invention.

Referring now to FIG. 3, an exploded perspective view of the first paint reservoir 105 and the second paint reservoir 110 as used with the dual reservoir, air powered, paint gun 100 is disclosed. The retaining base ring 115 is permanently affixed to the first paint reservoir 105 by means such as welding or adhesive. The second paint reservoir 110 is capable of being removed and inserted into the first paint reservoir 105/retaining base ring 115 combination as indicated by a first travel path 160. The purpose of making the first paint reservoir 105 removable from the second paint reservoir 110 is to aid in filling, transportation, emptying, and cleaning of their respective paints or finishes. It is also envisioned that multiple mating reservoirs could be utilized to allow quick changeovers when more than two different paints or finishes are required during one painting operation. When both the first paint reservoir 105 and the second paint reservoir 110 are mounted within the common retaining base ring 115, the retaining clamp 120 is slipped over the top of the first paint reservoir 105/second paint reservoir 110 pair to aid in their retention and alignment as indicated by a second travel path 165. A clamping means 170, such as a screw or friction clamp is used to slightly reduce the overall circumference of the retaining clamp 120 to aid in said retention and alignment activity. It is envisioned that the first paint reservoir 105 and the second paint reservoir 110 would be manufactured from aluminum using similar manufacturing techniques to those currently utilized in the production of conventional single reservoir, air powered, paint gun 5 (as shown in FIG. 1). However, it can be easily seen by those familiar in the art that other material and/or techniques could easily be substituted.

Figure 4:
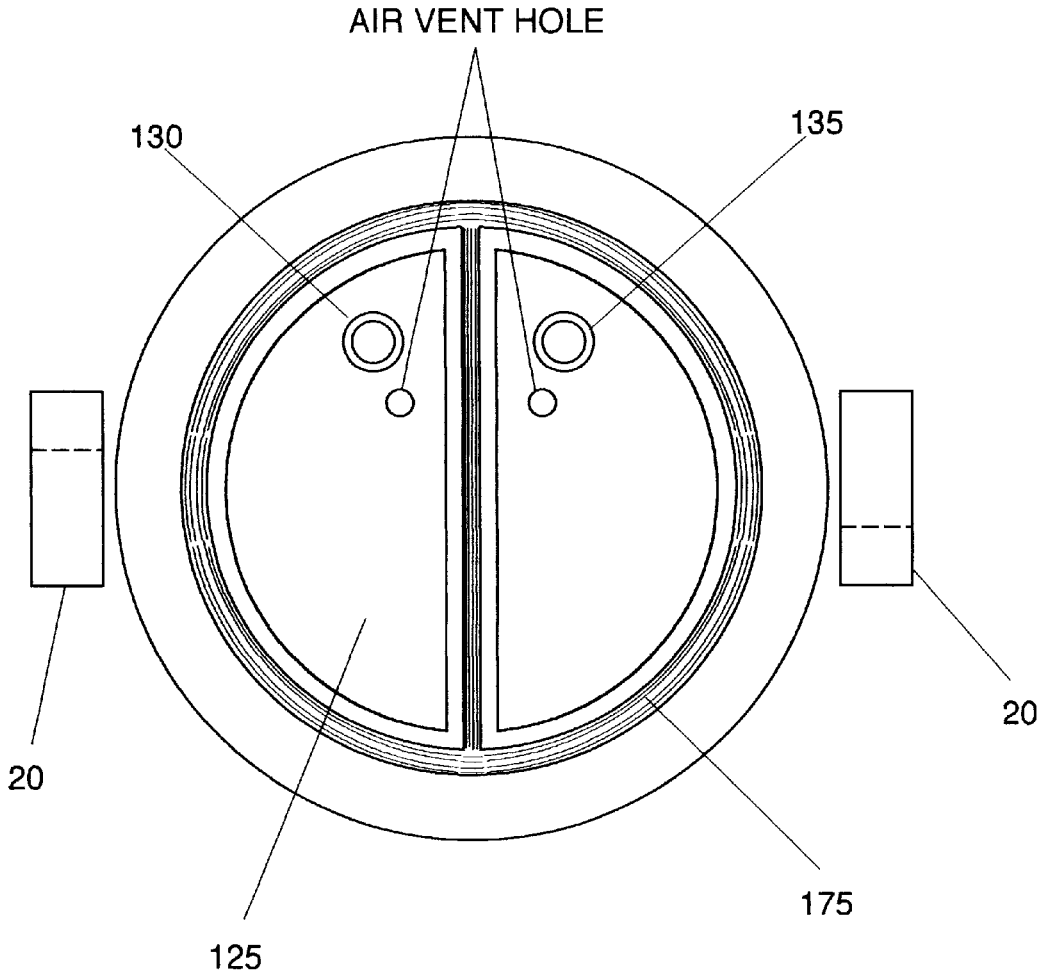
FIG. 4 is a sectional view of the dual reservoir, air powered, paint gun as seen along a line II—II in FIG. 2.

Referring finally to FIG. 4, a sectional view of the underside of the dual reservoir cap 125 as seen along a line II—II in FIG. 2 is disclosed. The exterior ends of the attachment clamp bar 20 are visible in this view as they would connect to the connecting studs 15 (not shown in this FIG.) Both the first dip tube 130 and the second dip tube 135 are visible protruding from the bottom of the dual reservoir cap 125. Finally, a dual reservoir cap gasket 175 is installed on the bottom of the dual reservoir cap 125 as would be necessary to form an airtight seal against the rims of both the first paint reservoir 105 (not shown in this FIG.) and the second paint reservoir 110 (not shown in this FIG.) It is envisioned that the dual reservoir cap gasket 175 would be manufactured from a flexible compound that would be impervious to the long term physical contact with the paint or other finishes as used with the conventional single reservoir, air powered, paint gun 5 (not shown in this FIG.). The dual reservoir cap gasket 175 could sit within a recessed channel as shown in this FIG. or could be surface mounted upon the dual reservoir cap 125 to facilitate its replacement on a periodic time basis.

2. Operation of the Preferred Embodiment

In operation, the present invention can be easily utilized by the common user in a simple and effortless manner. To use the present invention with its preferred embodiment can best be described in conjunction with the exploded perspective views of FIG. 2 and FIG. 3, and the sectional view of FIG. 4.

The user would begin utilization of the dual reservoir, air powered, paint gun 100 by separating the first paint reservoir 105 and the second paint reservoir 110, by removing the retaining clamp 120 and lifting the second paint reservoir 110 from the retaining base ring 115. Next, approximately one pint of paint or finish is poured in the first paint reservoir 105 and a pint of a different paint or finish is poured into the second paint reservoir 110. The second paint reservoir 110 is then inserted into the retaining base ring 115 and secured to the first paint reservoir 105 by use of the retaining clamp 120. Next, the dual reservoir cap 125 is placed onto the top of both the first paint reservoir 105 and the second paint reservoir 110 and secured with the use of the attachment clamp bar 20 and the rotating clamp lock 35. An air pressure connection with appropriate specifications is then made to the air connection inlet 60, and appropriate adjustments are made to the mixture adjustment controls 65. At this point the dual reservoir, air powered, paint gun 100 is ready to begin spray applications.

The user would begin painting by opening either the first shutoff valve 140 or the second shutoff valve 145 as desired to select the required paint or finish. Spray painting would then occur in a manner similar to experienced by users of conventional single reservoir, air powered, paint guns. The physical parameters of the dual reservoir, air powered, paint gun 100 with regards to weight, center of gravity, balance and the like would be closely approximated. When it is desired to switch to the other (second) paint or finish, the user would close the first shutoff valve (either the first shutoff valve 140 or the second shutoff valve 145) and then blow air through the paint mixing body 50 by activation of the trigger 70. After a sufficient time period of this action, all remaining residues from the first paint or finish would be removed from the paint mixing body 50. The user would then open the second shutoff valve (either the first shutoff valve 140 or the second shutoff valve 145) and repeat the above process to apply the second desired paint or finish. This cycle of closing one shutoff valve, blowing air through, and then opening the second shutoff valve would be repeated every time the user wished to change the paint or finish being applied. When finished with spraying applications, the dual reservoir, air powered, paint gun 100 is ready to be cleaned.

The user would remove the air source from the dual reservoir, air powered, paint gun 100 at the air connection inlet 60 and remove the dual reservoir cap 125 from the first paint reservoir 105/second paint reservoir 110 combination be releasing the rotating clamp lock 35 and lifting the said dual reservoir cap 125 off. Next, the retaining clamp 120 is removed, and the second paint reservoir 110 is separated from the first paint reservoir 105 by lifting the second paint reservoir 110 from the retaining base ring 115. Any remaining paint or finish is then emptied from the first paint reservoir 105 and the second paint reservoir 110. The first paint reservoir 105 and the second paint reservoir 110 are then cleaned and filled with an appropriate solvent and reattached to the dual reservoir cap 125 to aid in the cleaning of the remaining interior components of the paint mixing body 50. Finally, all components are cleaned and wiped clean with an appropriate solvent in a similar manner as would be used with a single reservoir, air powered paint gun. At this point, the entire process is ready to repeat the next time painting duties are required.

The foregoing description is included to illustrate the operation of the preferred embodiment and to describe the operation of the same to one skilled in the relevant art. It is not intended to be exhaustive or to limit the present invention to the precise form disclosed, and obviously many modifications and variations are possible in light of the above teachings. For example, it is presently envisioned that the present invention can be easily adapted to other particular methods of paint or coating application technology. Although an air powered spray gun may be used as an example of one particular method of coating application technology, the teachings and practices of the present disclosure can just as easily be applied to airless paint prayers, gravity feed paint sprayers, and the like. Therefore, the scope of present spray paint system with multi chambered, mixing reservoir is to be limited only by the following claims.

What is claimed is:

1. A multi-reservoir, air powered, paint gun comprising:

a first paint reservoir;

a second paint reservoir;

a retaining base ring for holding said first paint reservoir and said second paint reservoir in physical contact with one another;

a multi-reservoir cap having multiple dip tubes, one said dip tube for insertion into each paint reservoir respectively;

a tee section in fluid communication with each said reservoir for providing a common junction from the output all said reservoirs;

a connection collar in fluid communication with the common output of the tee section, said connection collar having a threaded connection for affixment to a conventional spray gun spray head;

a rotating clamp lock for providing a secure locking means between said physically attached reservoirs and said multi-reservoir cap; and wherein the section of the multi reservoir, air powered, paint gun comprising a paint mixing body, a handle, an air connection inlet, a mixture adjustment control, a trigger and a paint orifice are all identical in appearance and function to the same said components of a conventional, single chambered paint gun.

2. The multi-reservoir, air powered, paint gun of claim 1, wherein said retaining base ring is rigidly affixed to one said paint reservoir in such a manner as to allow said reservoir to be vertically supported in a secure manner when not in use.

3. The multi-reservoir, air powered, paint gun of claim 1, wherein each said first paint reservoir and said second paint reservoir are equipped with a single connecting stud, and further comprising:

an attachment clamp bar, said bar capable of mating with both said connecting studs in a manner similar to that of a conventional single reservoir, air powered, paint gun.

4. The multi-reservoir, air powered, paint gun of claim 1, wherein the capacity of at least one said paint reservoir one pint liquid.

5. The multi-reservoir, air powered, paint gun of claim 1, further comprising:

a shutoff valve located atop each said dip tube.

6. The multi-reservoir, air powered, paint gun of claim 1, further comprising:

a reservoir cap gasket manufactured from a flexible compound that would be impervious to the long term physical contact with the paint or other finishes.

* * * * *